US008234844B2

(12) United States Patent
Davlin et al.

(10) Patent No.: US 8,234,844 B2
(45) Date of Patent: Aug. 7, 2012

(54) PACKAGING ASSEMBLIES AND METHOD OF FABRICATING SAME

(75) Inventors: Anthony Orkin Davlin, Cambridge, MA (US); Laurence B. Sperry, Newton, MA (US)

(73) Assignee: Sealed Air Corporation (US), Elmwood Park, NJ (US)

( * ) Notice: Subject to any disclaimer, the term of this patent is extended or adjusted under 35 U.S.C. 154(b) by 0 days.

(21) Appl. No.: 12/902,416

(22) Filed: Oct. 12, 2010

(65) Prior Publication Data

US 2011/0023415 A1 Feb. 3, 2011

Related U.S. Application Data

(62) Division of application No. 11/497,931, filed on Aug. 1, 2006, now Pat. No. 7,882,954.

(51) Int. Cl.
*B63B 43/08* (2006.01)

(52) U.S. Cl. ..... 53/456; 53/467; 53/472; 53/139.5

(58) Field of Classification Search ..... 53/456, 53/467, 472, 474, 139.5, 139.6
See application file for complete search history.

(56) References Cited

U.S. PATENT DOCUMENTS

| | | | |
|---|---|---|---|
| 848,889 | A | 4/1907 | Fitzgerald |
| 1,791,367 | A | 2/1931 | McVay et al. |
| 2,860,768 | A | 11/1958 | Smithers |
| 2,979,246 | A | 4/1961 | Liebeskind |
| 3,389,534 | A | 6/1968 | Pendleton |
| 4,344,536 | A | 8/1982 | Oberhuber |
| 4,386,923 | A | 6/1983 | Okushita |
| 4,709,817 | A | 12/1987 | Keady et al. |
| 4,714,506 | A | 12/1987 | Yamashiro et al. |
| 5,340,632 | A | 8/1994 | Chappuis |
| 5,532,044 | A | 7/1996 | Jen |
| 5,577,616 | A | 11/1996 | Liang |
| 5,590,781 | A | 1/1997 | Shackelford et al. |
| 5,622,262 | A | 4/1997 | Sadow |
| 5,624,035 | A | 4/1997 | Kim |
| 5,755,329 | A | 5/1998 | Sadow |
| 5,806,683 | A | 9/1998 | Gale |
| 5,819,942 | A | 10/1998 | Sadow |

(Continued)

FOREIGN PATENT DOCUMENTS

| | | | |
|---|---|---|---|
| DE | 4132650 | A1 | 4/1993 |
| DE | 100 34 539.5 | A1 | 2/2002 |
| GB | 809 413 | | 2/1959 |

OTHER PUBLICATIONS

European communication dated Nov. 16, 2007 in corresponding foreign application (07010058.1).

(Continued)

*Primary Examiner* — Hemant M Desai
(74) *Attorney, Agent, or Firm* — Nields, Lemack & Frame, LLC

(57) ABSTRACT

A packaging assembly in which discrete cushioning or blocking and bracing members are strategically positioned so as to provide improved protection of an article such as during shipment and storage. The assembly includes a substrate and a predetermined 2- or 3-dimensional pattern of cushioning members such as inflated (e.g., gas-filled) bags selectively and optionally independently affixed to the substrate. The pattern of cushioning members is predetermined in the x, y and z directions such that, when the substrate is positioned about the article, e.g., by folding the substrate, point contact between the cushioning members and the article is created. A method of fabricating a shock protective assembly for packaging an article is also disclosed.

5 Claims, 11 Drawing Sheets

U.S. PATENT DOCUMENTS

| | | | | |
|---|---|---|---|---|
| 5,912,058 | A | 6/1999 | Takahashi et al. | |
| 6,000,545 | A | 12/1999 | Smith | |
| 6,073,770 | A | 6/2000 | Park | |
| 6,128,889 | A * | 10/2000 | Fuss | 53/472 |
| 6,149,002 | A | 11/2000 | Tiramani et al. | |
| 6,253,919 | B1 | 7/2001 | Sperry et al. | |
| 6,290,125 | B1 * | 9/2001 | Breda | 229/120.07 |
| 6,415,920 | B1 | 7/2002 | Tiramani et al. | |
| 6,431,361 | B1 | 8/2002 | Wolf | |
| 6,520,332 | B1 | 2/2003 | Barmore et al. | |
| 6,530,480 | B1 | 3/2003 | Hardy | |
| 6,532,721 | B1 * | 3/2003 | Weder | 53/474 |
| 7,254,932 | B2 * | 8/2007 | Tanaka et al. | 53/472 |
| 2003/0145561 | A1 * | 8/2003 | Cals et al. | 53/472 |
| 2006/0108256 | A1 | 5/2006 | Bussey, III et al. | |
| 2007/0095711 | A1 * | 5/2007 | Thompson et al. | 206/522 |
| 2009/0064638 | A1 * | 3/2009 | Corbett et al. | 53/472 |

OTHER PUBLICATIONS

European communication dated Jan. 21, 2010 in corresponding foreign application (07010058.1).
European communication dated Nov. 8, 2010 in corresponding foreign application (07010058.1).
Office Action dated May 5, 2009 in corresponding U.S. Appl. No. 11/497,931.
Final Rejection Office Action dated Oct. 14, 2009 in corresponding U.S. Appl. No. 11/497,931.
Office Action dated Jan. 29, 2010 in corresponding U.S. Appl. No. 11/497,931.
Final Rejection Office Action dated Jun. 28, 2010 in corresponding U.S. Appl. No. 11/497,931.
Notice of Allowance dated Oct. 1, 2010 in corresponding U.S. Appl. No. 11/497,931.

* cited by examiner

PACKAGING ASSEMBLIES AND METHOD OF FABRICATING SAME

This application is a divisional of U.S. patent application Ser. No. 11/497,931 filed Aug. 1, 2006, the disclosure of which is incorporated herein by reference

FIELD OF THE INVENTION

The present invention is directed toward packaging assemblies and a method for creating such assemblies in which a cushioning material is provided in a predetermined configuration.

BACKGROUND OF THE INVENTION

Conventional bubble packaging material such as that sold under the trademark Bubble Wrap® by Sealed Air Corporation has been widely used for packaging articles for shipping and/or storage. Similarly, inflatable dunnage bags have been used to fill void regions in containers carrying articles for shipment and/or storage. The objective of the packaging material is to cushion the product during storage and transportation to protect it from damage. The packaging material is intended to cushion and reduce or eliminate excessive movement of the article in the container even upon an impact to the container, thus providing impact protection to the article during shipment and storage.

Other forms of protective packaging for articles of different sizes and shapes include waste paper, embossed paper, molded foams, and plastic beads, often referred to as "peanuts".

Typically, the article to be protected is placed in a container and the protective packaging material is then placed about the article in an effort to fill the voids that form between the article and the container walls. This process, however, can be inefficient and inadequate, in that the optimum amount of protective packaging material is difficult to determine, usually resulting in the use of an insufficient or excess amount of packing material. The use of excess material is unnecessarily expensive, and can present a disposal problem once the container reaches its final destination and the article intended to be protected is removed from the container. The use of insufficient amounts of packaging material can result in ineffective cushioning of the article. In either case, there is no guarantee that the packaging material will conform as desired to the shape of the article and that the article will not become displaced during transportation of the container, thereby compromising the cushioning ability of the packaging material. It therefore would be desirable to provide a protective cushioned packaging system and fabricated assembly that ensures that the optimum amount of cushioning material is used for packaging a given article, and ensures that the material is strategically placed in predetermined locations to create selected point contact with the article, to block and brace the article, to inhibit or prevent movement of the article, and/or to provide improved impact protection during shipment and storage.

It is also advantageous to produce the system at the point of use so that no inventory space or transportation costs are involved.

It further would be desirable to provide an efficient, reproducible method of forming such a packaging assembly.

SUMMARY OF THE INVENTION

The present invention provides a packaging assembly in which discrete cushioning or blocking and bracing members are strategically positioned so as to provide improved protection of an article such as during shipment and storage. The assembly includes a substrate and a predetermined 2- or 3-dimensional pattern of cushioning members such as inflated (e.g., gas-filled) bags selectively and optionally independently affixed to the substrate. The pattern of cushioning members is predetermined in the x, y and z directions such that, when the substrate is positioned about the article, e.g., by folding the substrate, point contact between the cushioning members and the article is created. In one embodiment the cushioning members are arranged only in the x and y directions while in another embodiment the members are arranged in the x, y, and z directions. Thus, in the latter embodiment some or all positions may have cushioning members stacked or layered in the z-direction on the substrate. The particular configuration of the cushioning members on the substrate depends in part upon the configuration of the article being protected, the regions of fragility on the article, the relative location of the article and the substrate, and/or the configuration of the substrate and/or container in which the article is to be placed. The cushioning members can position the article in a spaced apart relationship with the substrate. The substrate can be a sub-container or insert adapted to fit within a prime or outer container or receptacle for the article, or can be the prime container itself. In certain embodiments the substrate is foldable, and is substantially flat in its unfolded state, providing a plurality of panels for cooperative assembly into a three-dimensional sub-container or container such as a carton. In certain embodiments the cushioning members are preformed, and are adhered to the substrate and, where needed or desired, to each other while the substrate is in its unfolded state. The resulting engineered packaging assembly provides protection against shock and vibration during shipping and handling, and also can be used for void filling.

In its method aspects, the present invention is directed to a method of fabricating a packaging assembly comprising the steps of providing a substrate and positioning at least one cushioning member in a predetermined pattern on the substrate in the x, y directions and, optionally, in the z direction (where a plurality of such members are used). The member(s) lying in the x and y axes are preferably affixed to the substrate. The members stacked in the z axis are preferably affixed to each other, and may or may not be otherwise attached to one another (such as a chain of members). The arrangement of the cushioning members is determined based upon the configuration of the article being packaged, any areas of fragility of the article, the location that the article will be placed in the package relative to the substrate, and/or the configuration of the substrate and/or container in which the article is to be placed. In certain embodiments the substrate is a foldable substrate that is in its unfolded state when the cushioning members are affixed to it. The foldable substrate can then be folded to provide a container for the article to be packaged in which the cushioning members are in the interior and form a three dimensional cavity that conforms to all or part of the shape of the packaged article, or the substrate can be an insert for an outer container.

DETAILED DESCRIPTION OF THE INVENTION

The present invention relates to a packaging assembly comprising a substrate and a plurality of cushioning members such as inflated cushions positioned on the substrate so as to form an interior cavity of a predetermined shape. The shape of the interior cavity derives from the size and placement of the cushioning members. The cushioning members can be affixed to the substrate and to each other. The substrate can be an insert for a prime container, and can have panels hingedly connected to one another in such a manner that by folding and unfolding the panels upon the hinges (which can simply be folds), the substrate may be closed and opened. The cushioning members can be affixed to one or more of these panels in a predetermined pattern to create point contact with the article upon folding of the panels. Cushioning members also can be appropriately placed between the prime container and the substrate, such as on the prime container itself, so as to be positioned to cooperate with those on the substrate to effectively cushion the object being packaged. Alternatively, the prime container can function as the substrate, or the cushioning devices can be adhered to one another, such as in the form of a chain, thereby eliminating the need for a separate substrate, or can be immobilized with an outer layer of heat shrink film, the heat shrink film, in effect, becoming the substrate.

Figure 1:
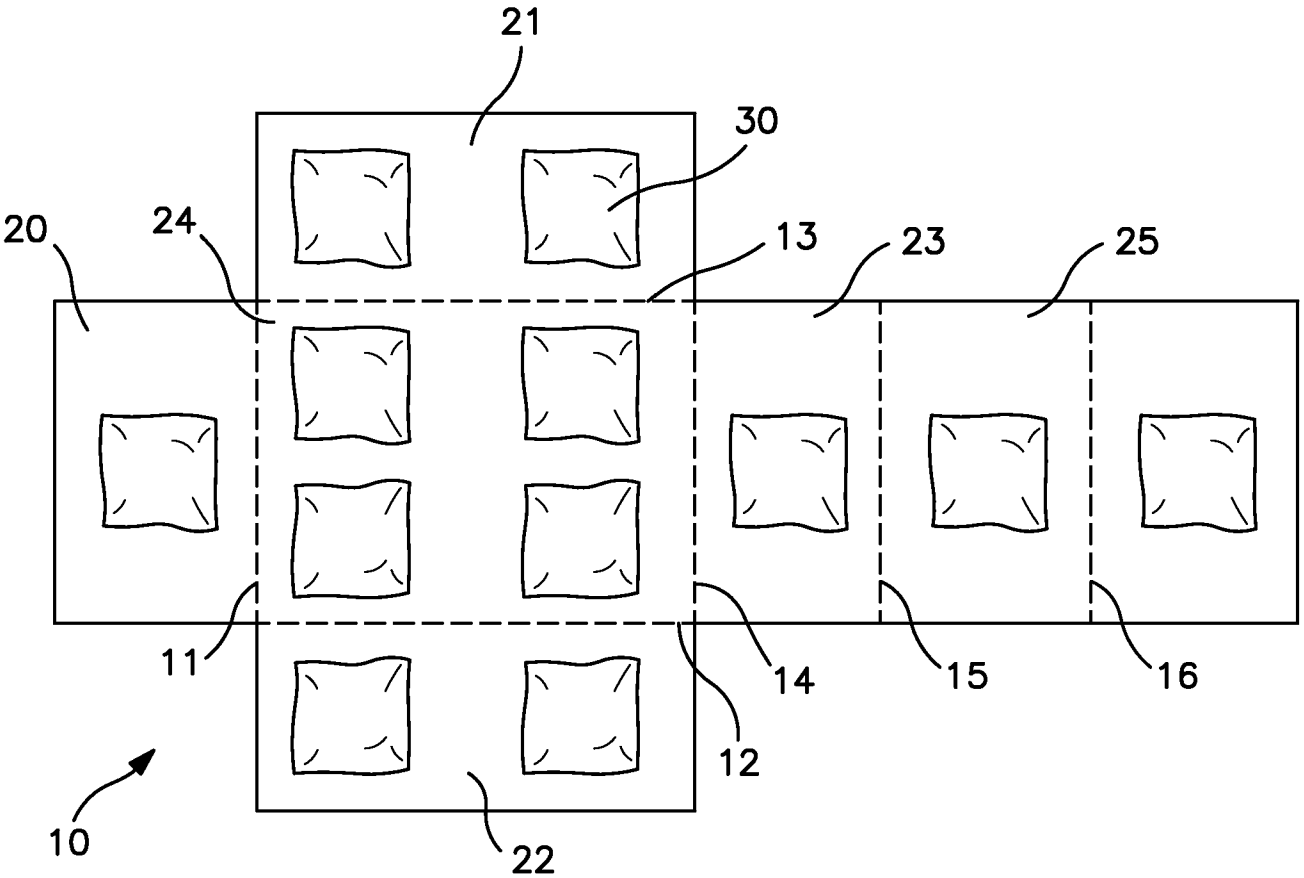
FIG. 1 is a top view of an embodiment of a substrate having a pattern of cushioning members in accordance with the present invention.

Turning first to FIG. 1, there is shown a T-fold substrate 10, in a collapsed unfolded state, which has been pre-folded (or scored) along lines 11, 12, 13, 14 and 15, thereby creating, upon assembly, four side surfaces 20, 21, 22 and 23, a bottom surface 24 and a top surface 25 that cooperate to form a container. In this embodiment, top surface 25 is further folded along line 16 to allow easier access to the contents of the substrate when it is folded to form a container, receptacle or enclosure. This substrate, when folded, can serve as the actual container, or can serve as an insert into an outer or prime container (which can optionally have one or more cushioning devices affixed to it (or between it and the insert) for additional cushioning). Indeed, where an outer container is used, the outer container can provide the necessary structural integrity to the overall package. The substrate can be rigid or flexible, and can be made of any suitable material, including cardboard, corrugated cardboard, corrugated plastic, film, TYVEX, plastic, paperboard, laminates, wood, mesh, netting, metal, etc. It can be configured in any suitable shape to accommodate the object to be packaged, and/or to accommodate any outer container used to house the object and the substrate. Similarly, the materials of construction of the outer container are not particularly limited, and include plastic, wood, metal, netting, mesh, cardboard, corrugated cardboard, etc.

Returning to FIG. 1, there is shown a plurality of cushioning members 30, which are sealed gas-filled (e.g., air-filled or nitrogen-filled) bags made of a pliable polymeric material. Although air will be the typical gas used, other gases can be used and can be chosen based upon their compressibility in order to optimize the load-bearing properties of the bags (the term "gas-filled" or "air-filled" as used herein does not imply that the member or bag is completely filled with gas or air; partially filled members or bags are well within the scope of the invention). Gas-filled bags are a preferred type of cushioning member for this invention. The use of gas-filled bags allows for the formation of a cavity having a precise and consistent geometry using the optimal amount of cushioning material. They are therefore preferred over other cushioning materials such foams formed in situ that may not consistently provide the desired geometry or use an optimal amount of material.

Suitable materials of construction for the gas-filled bags include linear low density polyethylene, medium density polyethylene, high density polyethylene, polyester, nylon, latex, heat sealable film, RF sealable film, multi-layer films, polyolefin blends, puncture resistant materials (such as films with an outer layer of PET), and other materials typically used for such bags that are known in the art. The bags may have a smooth outer surface or may be pleated. Those skilled in the art appreciate that the load-bearing characteristics of the bags are in part a function of the particular characteristics of the material used to form the bags (such as the elasticity of the material), and thus the load-bearing characteristics of the bags can be modified by changing the character of the film used. These cushioning members 30 are preferably affixed to the substrate 10 with an adhesive, such as by gluing (e.g., with a hot melt gun), although other methods of affixing the cushioning members are possible and within the scope of the invention. Preferably the adhesive is applied in a spray pattern to cover a large surface area of each cushioning member to effectively adhere the members to the substrate or to another member 30, as the case may be. The particular adhesive used must be strong enough to maintain adhesion during storage and transportation of the package. A suitable adhesive is a hot-melt adhesive, such as Loctite 0439 HYSOL hot melt adhesive. Although three-dimensional inflatable valveless air bags are illustrated and are the preferred cushioning members. In addition, different films with different elasticities can be used for the cushioning members, depending upon the cushioning properties (e.g., energy absorbing properties) desired.

The shape of the bags is not particularly limited, and can be chosen depending on the shape of the article to be packaged. Bags with square or rectangular cross-sections are typical. Also, a single bag can be pleated or formed from several small chambers which communicate with each other or are independent.

Figure 1A:
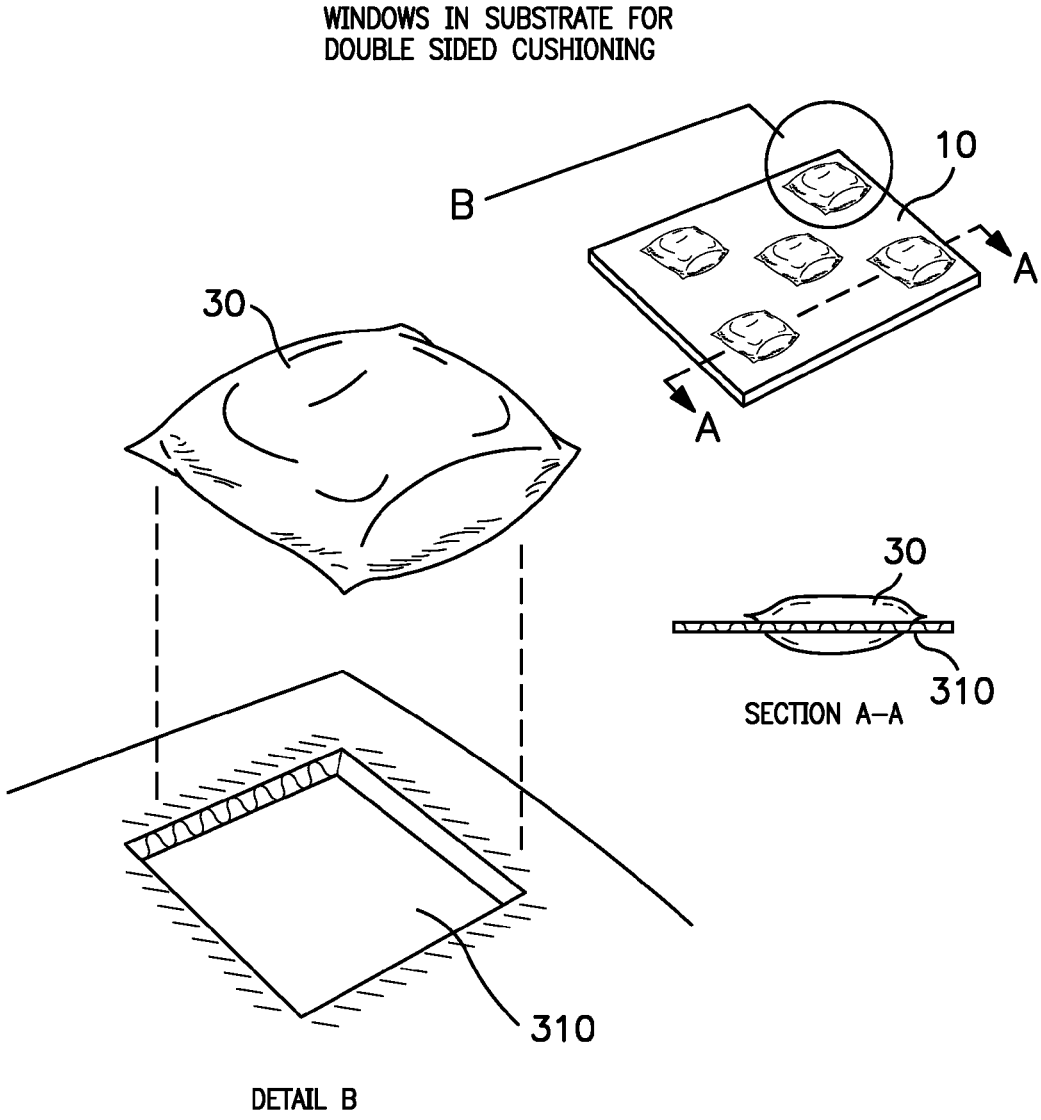
FIG. 1A is an exploded view of a substrate having a window in accordance with an embodiment of the present invention.

The substrate 10 need not be continuous; one or more apertures or "windows" can be provided and one or more cushioning members can be positioned therein so that it extends through the window(s), thereby providing cushioning protection to both sides of the substrate. This is shown in FIG. 1A, where section A-A and B illustrates a cushioning member 30 protruding through a window 310 in the substrate 10. Although in Section A-A there are approximately equal amounts of the cushioning member 30 on each side of the substrate, those skilled in the art will appreciate that one side of the substrate could have more or less of the cushioning member protruding from the window 310.

The substrate 10 need not be rigid. It can be a heat-shrinkable film that is heat shrunk about the cushioning members and the object once the object and cushioning members are properly assembled. The substrate also could be a non-heat shrinkable film, which is secured shut when the pack is assembled such as with an integral tape strip. Flat pads could be formed by adhering the inflated bags to a substrate whereby the pads are used to block and brace objects within a container on the sides but not the top and bottom. In addition or alternatively, a heat shrinkable film can be wrapped around the substrate, the cushioning members and the object and heat shrunk thereabout, to create a common package that encapsulates the object, the substrate and the cushioning members and thereby enables objects of varying sizes to be packaged regardless of the configuration of the substrate. The resulting heat shrunk package can be complete as such, or can be inserted into a further outer container such as for storage and/or transportation. This outer container can itself include cushioning members.

Figure 2:
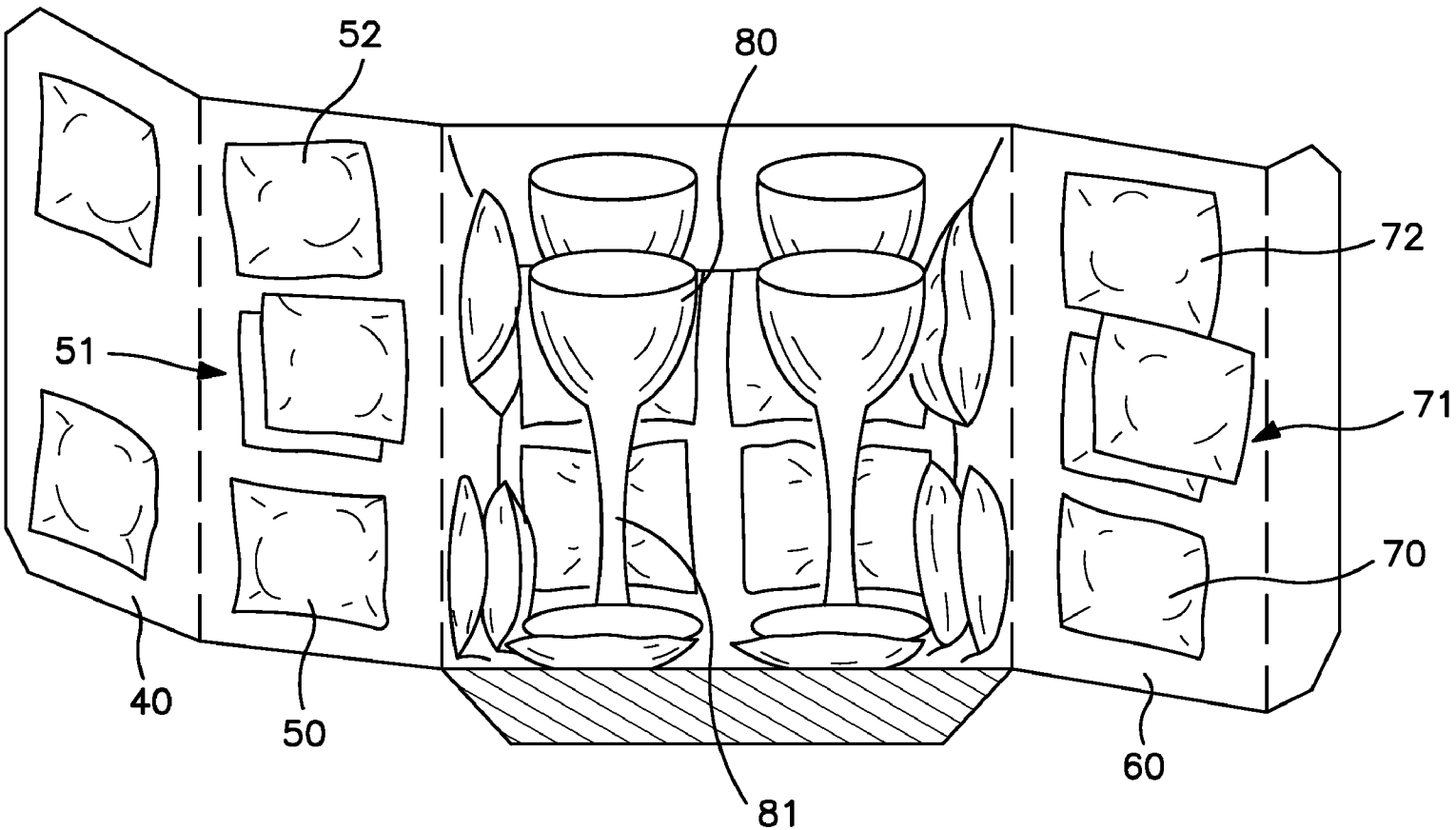
FIG. 2 is a top view of a second substrate having a pattern of cushioning members in accordance with the present invention.

The location of the cushioning members on the substrate 10 is preferably predetermined based upon the size and shape of the object to be packaged, any regions of fragility of the object to be packaged, and/or the configuration of the substrate and/or container in which the article is to be placed, in order to achieve the desired or required degree of cushioning or load absorption necessary to adequately protect the object or regions thereof, or to block and brace the package (e.g., keep objects firmly within a container from shifting and moving, which may or may not incorporate shock or cushioning capabilities). The necessary degree of cushioning or blocking and bracing can be determined by trial and error, or based upon previous experience with the particular object being packaged (e.g., by observing where the object is most fragile and requires the most cushioning). For example, as shown in FIG. 2, the narrow stem region of a wine glass may require more cushioning than the base, and thus the location on the substrate and/or in the container where this region of the object will be placed can include the appropriate configuration of cushioning members to fill undesirable voids and to adequately cushion the stem. An objective is to use the least amount of material while obtaining the most amount of protection, creating sufficient points of contact between the cushioning members and the article to absorb load, inhibit or prevent movement of the article, and support the article.

In the embodiment shown in FIG. 1, the object to be placed within the substrate is of a regular shape, thus the cushioning members 30 are placed in regular spaced intervals on the bottom surface 24, and the four side surfaces 20, 21, 22 and 23. The size and shape of the object to be placed in the container also determines the thickness of the cushioning member at various locations on the substrate. In the preferred embodiment, for ease of fabrication, each cushioning member is identical or at least very similar in shape and size. Therefore, variations in the thickness of the cushion can be achieved through the use of multiple cushioning members arranged in a stacked manner. Alternatively or in addition, variations in thickness of the cushion can be achieved by the fill volume of the cushioning members, i.e., the degree to which the cushions are inflated (e.g., 100% inflated, 75% inflated, 50% inflated, etc.) and/or by the use of a larger or smaller sized cushion in selected locations.

In the preferred embodiment, thickness (or height) is achieved by affixing a subsequently applied cushioning member to one that has been previously affixed to build arrays in the z-direction. Alternatively, stacks of cushioning members can be preformed and then affixed to the substrate as a unit. As shown in FIG. 2, it can be seen that certain cushioning regions associated with surfaces of the substrate are comprised of two cushioning members, where one of the two is affixed to the substrate and the other of the two is affixed to the first, again preferably by gluing. Although in this embodiment, each stacked set of cushions has two cushioning members, the invention is not so limited. The height of the cushioning stack is not particularly limited, nor is it necessary to have uniform stacks on the substrate. Stacked devices also can be chains of bags, with each cushion in a chain being folded over an adjacent cushion in an alternating or zig-zag pattern. The air can be separately sealed in each bag or the air within each bag of a given chain can communicate with the air in other bags of the same chain.

Figure 9:
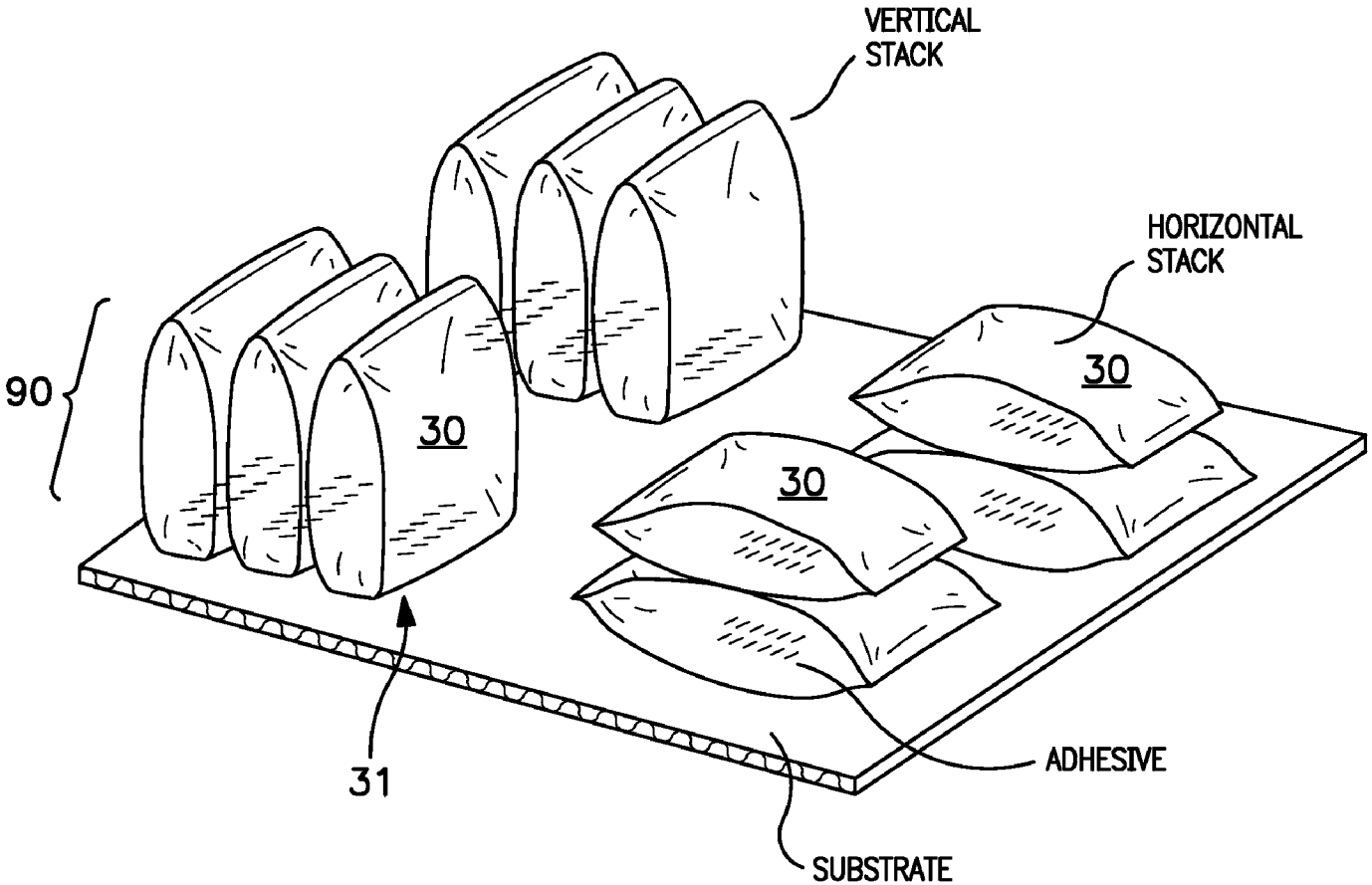
FIG. 9 is a perspective view of a substrate with a plurality of cushioning members arranged in various stacks and arrays.

Arrays also can be formed in the x or y-direction, forming a pattern of cushioning members 90 in side-by-side relation, each standing on an edge 31, as shown in FIG. 9. These arrays can be formed with chains of bags, or each bag can be separate from the next.

Furthermore, it is not necessary that each cushioning member within a stack or array be the same size or that each cushioning member within a stack or array exactly overlap each other cushioning member within that same stack or array; the cushioning members can be stacked or arrayed in an offset manner if desired.

The process of depositing multiple cushioning members on a substrate in a three-dimensional array can be analogized with inkjet printing where particles of ink are deposited at predetermined, discrete locations on a substrate, and multiple particles can be placed in the same location as required to build up or enhance the image. For example, different color particles of ink may be placed at the same location to achieve a particular color. By analogy, multiple cushioning devices may be placed at the same two-dimensional location (e.g., at the same x and y coordinates) to achieve a particular cushioning height and cushioning effect along the z-coordinate.

Figure 3:
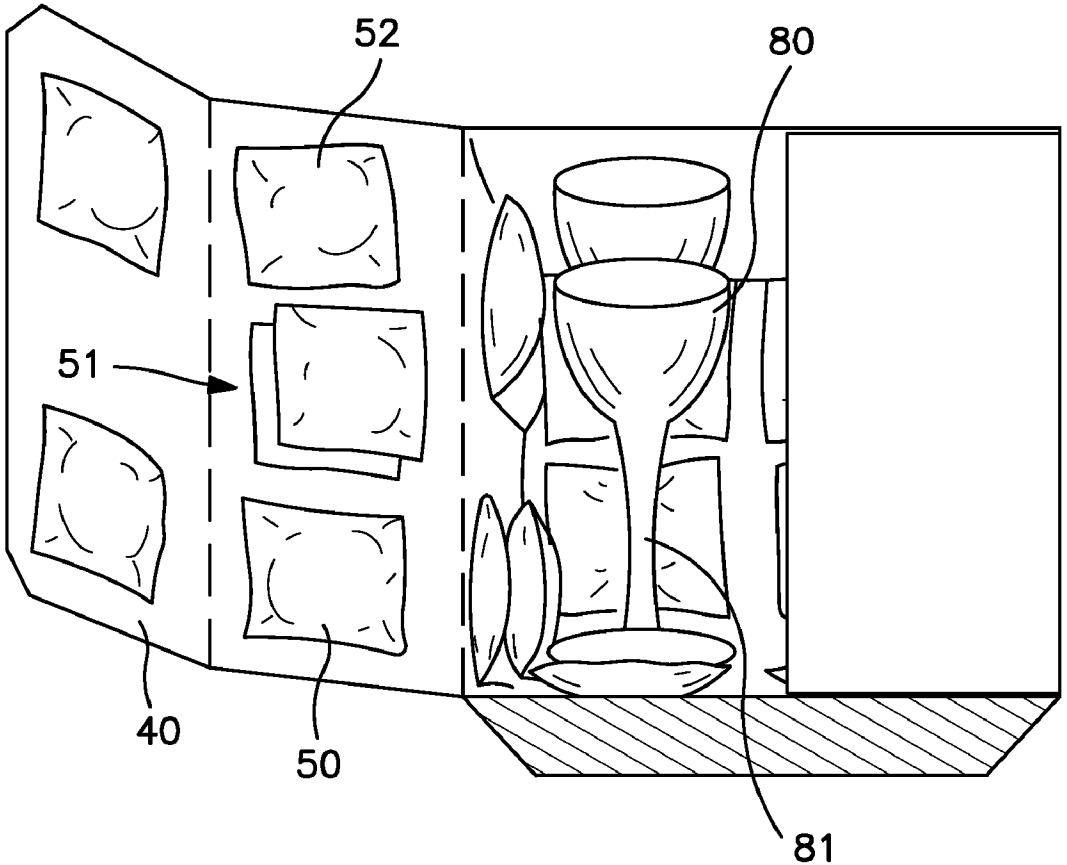
FIG. 3 is a top view of a partially assembled packaging assembly in accordance with the present invention.

FIGS. 2 and 3 show the use of cushioning members for a substrate that is to contain non-regular shaped objects, such as one or more wine glasses 80. As above, the location and number of cushioning members are determined by the shape of the article that is to be placed in the container, the location of any regions of fragility of the article, the location of the article in the package relative to the substrate, and/or the configuration of the substrate and/or container in which the article is to be placed, to achieve the appropriate cushioning necessary to adequately protect the article, particularly during transportation and handling. In this embodiment, the article has a narrow midsection 81 (i.e., the wine glass stem) that is particularly fragile. Therefore, as seen on side surface 40, to protect this thin area, cushion 51 is thicker than either cushion 50 or cushion 52, thereby filling the void between the stem and the container, minimizing or preventing movement of the wine glass during shipping or handling. Similarly, on side surface 60, cushion member 71 is thicker than either cushion member 70 or cushion member for the same reason. While cushions 51 and 71 each comprise two cushioning members with one affixed atop the second (preferably along their peripheral edges), the invention is not so limited. The cushion can be made of any number of cushioning members affixed in a vertical manner. Similarly, the size and/or fill volume of each individual cushioning member can be appropriately varied to achieve the same effect.

Figure 6:
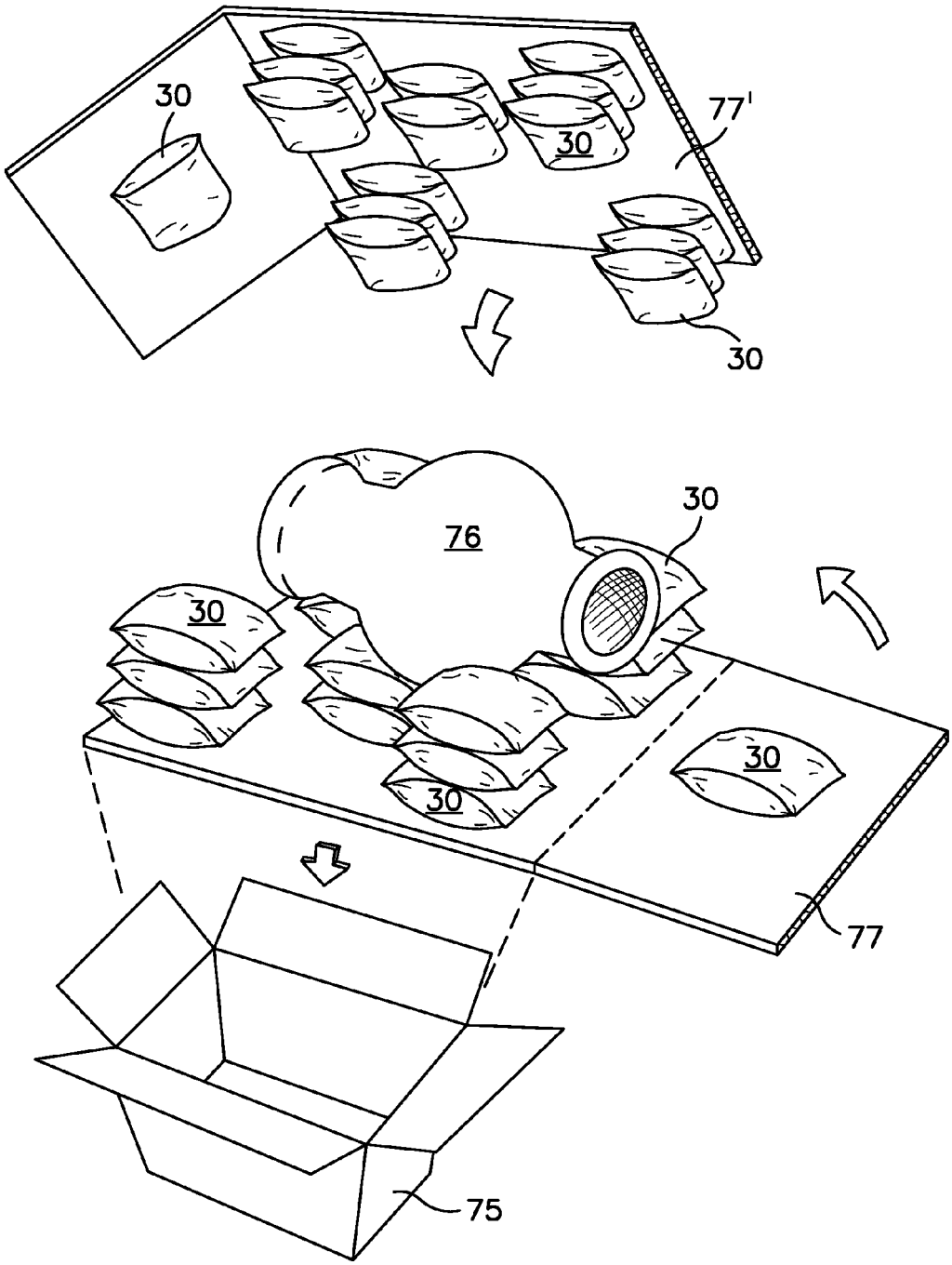
FIG. 6 is an exploded view of an embodiment of an insert and an outer container for packaging an article in accordance with the present invention.

FIG. 6 illustrates an embodiment where an outer container 75 is used, and the article to be packaged 76 rests on a plurality of cushioning members 30 that are selectively adhered to an insert 77 for the outer container 75. A second insert 77' cooperates with the first insert 77 to together form a four-sided insert and further protect the article 76, the second insert also including a plurality of selectively placed air bags 30 as shown. The first and second insets 77, 77' have suitable folds so that they can be folded and placed within the outer container 75.

Figure 7:
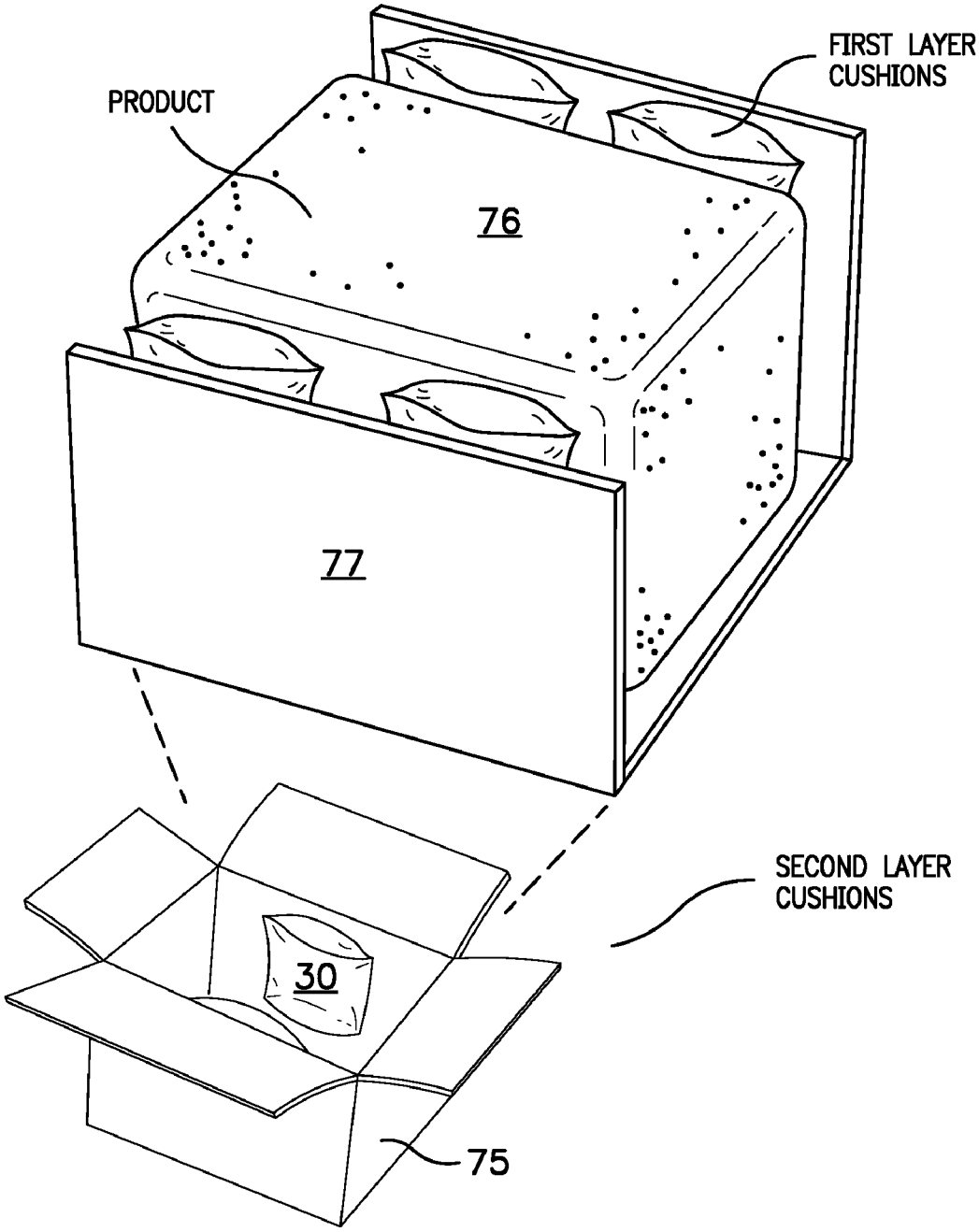
FIG. 7 is an exploded view of another embodiment of an insert and an outer container for packaging an article in accordance with the present invention.

FIG. 7 illustrates another embodiment where the article to be packaged 76 is placed within an insert 77 having cushioning members 30 affixed thereto, for further insertion into an outer container 75. In this embodiment, the outer container 75 also includes one or more cushioning members 30 affixed to an inner surface thereof to further protect or block and brace the article 76. A further insert (not shown) and suitable cushioning members can be added, if desired, to create sides and a top in order to completely envelope the article 76.

Figure 8:
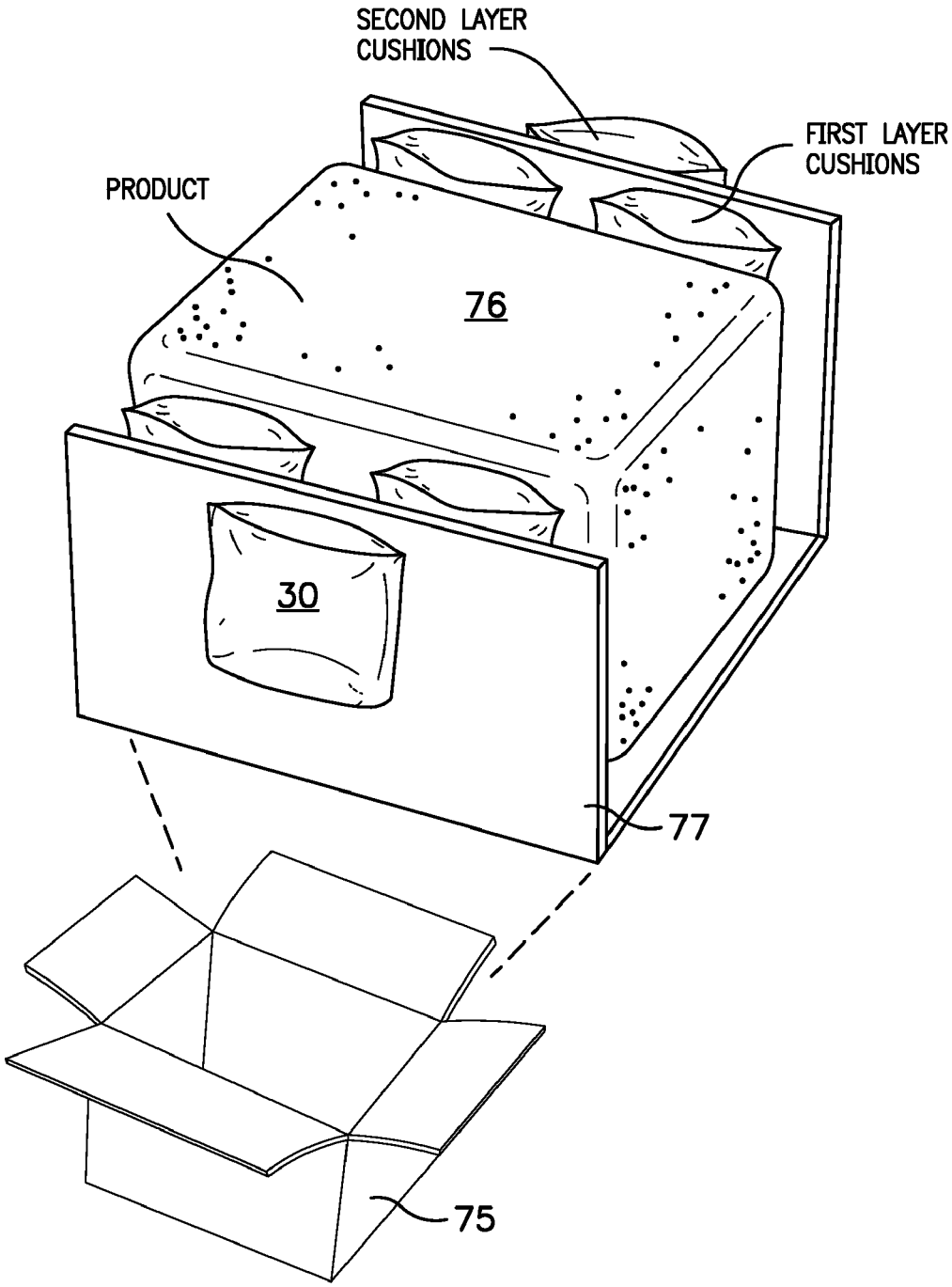
FIG. 8 is an exploded view of yet another embodiment of an insert and an outer container for packaging an article in accordance with the present invention.

FIG. 8 shows a similar embodiment, except that one or more cushioning members 30 are affixed to the outer surface of the insert 77 rather than (or in addition to) the inner surface of the outer container 75.

Figure 4:
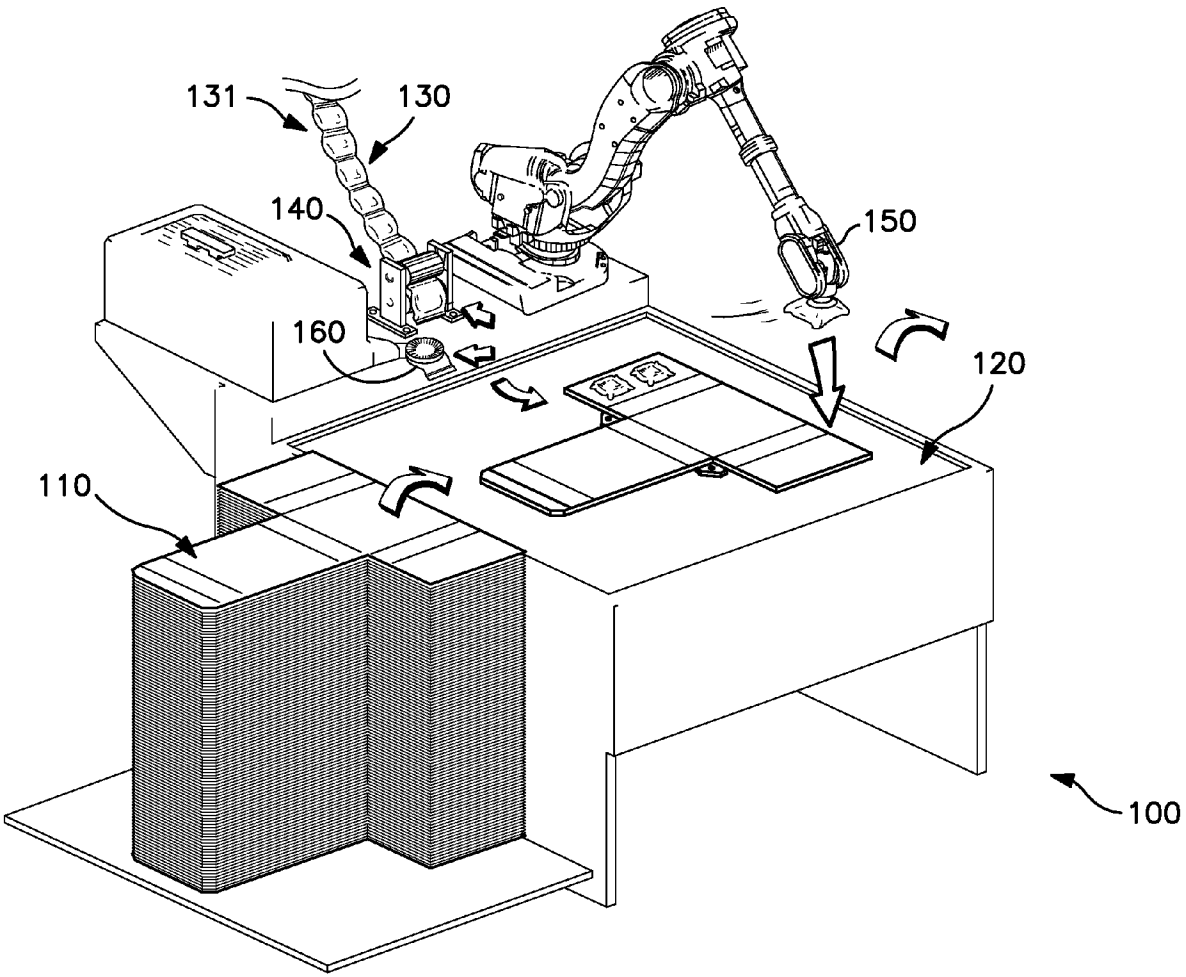
FIG. 4 is a first embodiment of an apparatus to apply cushioning devices to a substrate in accordance with the present invention.

FIG. 4 shows an example of an apparatus 100 that can be used to engineer the cushioning substrate. In the embodiment shown, each substrate comprises a pre-scored unfolded cardboard box 110, which preferably is stored near the apparatus 100 so that it can be readily accessed. One such substrate is placed on workspace 120, either manually or automatically, making it accessible to the apparatus for further processing. In the embodiment shown, cushioning members 130 preferably are available through a continuous feed, such as a reel 131 or the like and are fed though a mechanism 140, which dispenses them individually in a pre-formed (e.g. inflated) state. The mechanism 140 also can separate individual cushioning members or a chain of more than one member from the remainder of the reel, such as by cutting. Robotic arm 150 retrieves each cushioning member 130, preferably one at a time. The arm 150 can hold the cushioning member in a number of ways, including but not limited to suction, a weak adhesive, or robotic fingers.

Responsive to instructions, the robotic arm 150 brings the held cushioning member in contact with a glue application area 160, where a suitable amount of adhesive is applied to the member 130. Alternatively or in addition, adhesive can be applied to the substrate, preferably only in the location or locations where cushioning devices will be affixed. Alternatively still, the adhesive can be spray applied to the cushioning member(s) prior to, during or after the robotic arm retrieves it, or a tape adhesive carrier could be used. Also, the bags could be heat sealed to one another in order to form a stack or array of cushions. The cushioning member 130 is then placed on the substrate 110, or atop a previously affixed cushioning member, as the case may be. When all of the required cushioning members have been affixed, the substrate is removed from the workspace 120 and a subsequent substrate replaces it.

Figure 5:
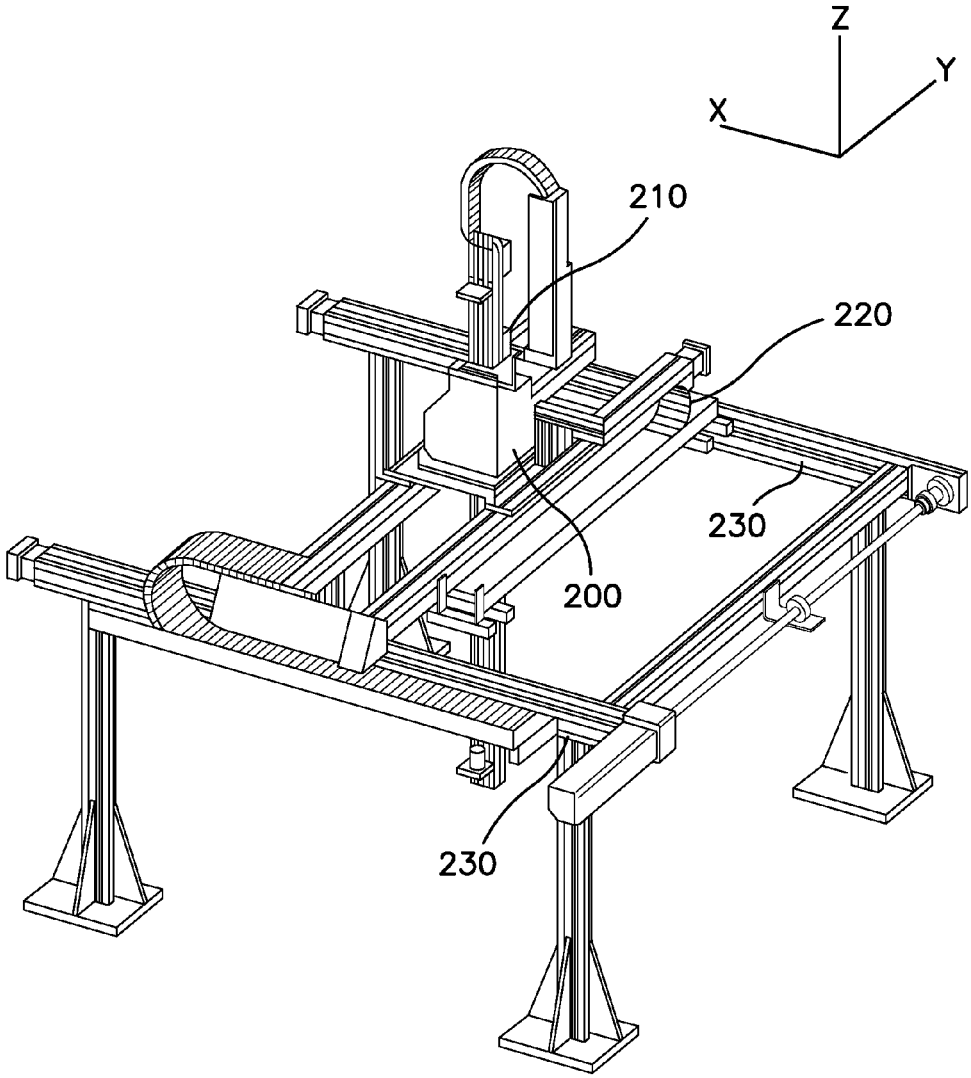
FIG. 5 is a second embodiment of an apparatus to apply cushioning devices to a substrate in accordance with the present invention.

A gantry system also can be used to apply the cushioning devices to a substrate. FIG. 5 shows a representative system that can be employed. In this embodiment, the head of the machine 200 rests on a mechanism 210 that moves in the Z-direction. This Z mechanism rests on a rail or set of rails 220 that move in the Y-direction. Finally, this rail or set of rails 220 rests on a second set of rails 230 which allow movement in the X-direction. Through suitable programming, the system can be made to execute any number of movements to various coordinates. For example, the cushioning members can be stored near the edge of the system's range of motion, with the glue application area nearby. The head of the machine is instructed to travel to the coordinates where the cushioning members are located, retrieves one or more members such as by suction, transports it to the glue application area where adhesive is applied, and finally transports it to the coordinates where the cushioning member(s) is to be applied to the substrate. This process is then repeated until all of the required cushioning members are placed either directly on the substrate or placed atop previously applied cushioning members. Those skilled in the art will appreciate that a single cushioning member also can be placed on top of two or more cushioning members.

It is not necessary for the dispenser of the cushioning devices to move to place the cushioning members in the appropriate locations. Rather, there need only be relative motion between the dispenser and the substrate. For example, the dispenser can remain stationary while the substrate is positioned to be moved so that the locations on which cushioning members are to be placed are directly beneath the dispenser. Alternatively, both the dispenser and the substrate could be moved accordingly. In addition, although the cushioning members illustrated are pre-formed inflated bags, it is within the scope of the present invention to use bags that are inflated during or after affixation to the substrate. For example, an uninflated string of cushions could be fed into the head 200 of FIG. 5 and inflated and sealed therein prior to placement on the substrate. The degree to which the bags are inflated also can be varied, depending upon the cushioning effects desired or required for the particular application.

Regardless of the mechanism used to transport and affix the cushioning devices to the substrate, the cavity created is controlled by the size and selective placement of the individual cushioning members. The use of smaller individual air bags made of low cost material can provide high load-bearing capacity and increased hoop strength at an economical cost. By the selective placement of the cushioning members, optimal cushioning can be achieved while using the least amount of material.

Where robotics is used to appropriately position the cushioning members, the robotics is preferably servo-controlled and is responsive to suitable programming, which provides appropriate instructions on where to locate the cushioning members. The particular location of each individual cushioning member is predetermined, such as by basing the locations on past experience with the product being protected, by trail and error, and/or by experimental design.

Figure 10:
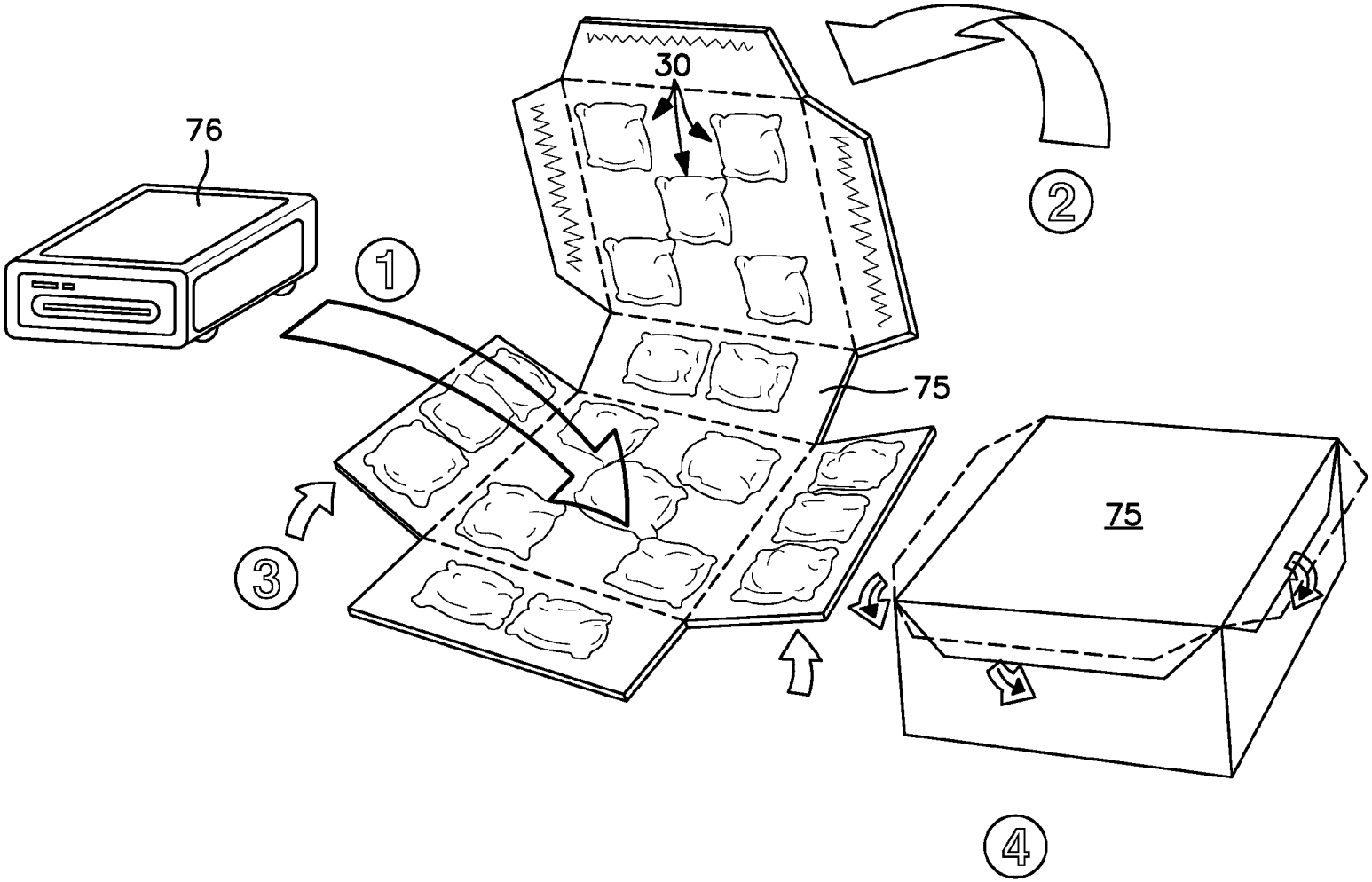
FIG. 10 illustrates steps carried out in packaging an article.

As shown in FIG. 10, an article to be packaged 76 is introduced onto a substrate 75 (as represented by arrow 1) with affixed cushioning members 75, creating point contact between the article 76 and cushioning members 30. The substrate is then folded (arrow 2) about the article 76, and becomes (or is optionally an insert for and is placed in) a prime container and is sealed.

What is claimed is:

1. A method of fabricating a shock protective assembly for packaging an article, comprising:

providing a substrate;

providing a first gas-filled bag;

determining the shape of said article;

determining fragile regions of said article;

determining the intended location and positioning of said article on said substrate; and selectively and independently positioning said first gas-filled bag on said substrate based upon the determined shape of said article, the determined fragile regions of said article, and the determined intended location and positioning of said article on said substrate.

2. The method of claim 1, wherein said first gas filled bag is partially inflated.

3. The method of claim 1, wherein there are a plurality of gas filled bags, and wherein at least some of said plurality of gas-filled bags are arranged in a three-dimensional array that includes at least one location where a plurality of gas-filled bags are stacked vertically relative to said substrate.

4. The method of claim 1, wherein said substrate is cardboard.

5. The method of claim 1, further comprising forming said substrate into a receptacle for said article and positioning said article in said receptacle in accordance with said determined location and positioning, wherein said first gas-filled bag positions said article in a spaced apart relationship with said substrate.

* * * * *